United States Patent [19]

Tsukakoshi

[11] Patent Number: 4,832,613

[45] Date of Patent: May 23, 1989

[54] ELECTRICAL CONNECTOR HAVING A MOVABLE GUIDE MEMBER

[75] Inventor: Masao Tsukakoshi, Kawasaki, Japan

[73] Assignee: AMP Incorporated, Harrisburg, Pa.

[21] Appl. No.: 145,428

[22] Filed: Jan. 19, 1988

[30] Foreign Application Priority Data

Jan. 26, 1987 [JP] Japan ..... 62-9823[U]

[51] Int. Cl.[4] ..... H01R 13/453

[52] U.S. Cl. ..... 439/141; 439/274

[58] Field of Search ..... 439/136–141, 439/271–274

[56] References Cited

U.S. PATENT DOCUMENTS

| | | | |
|---|---|---|---|
| 3,271,725 | 9/1966 | Bloch | 439/141 |
| 3,394,339 | 7/1968 | Gaskievicz et al. | 439/589 |
| 3,651,444 | 3/1972 | Desso et al. | 439/141 |
| 3,670,290 | 6/1972 | Angele et al. | 439/325 |
| 3,747,047 | 7/1973 | Carter et al. | 439/141 |
| 3,970,352 | 7/1976 | Dorrell et al. | 439/595 |
| 4,402,566 | 9/1983 | Powell et al. | 439/589 |

*Primary Examiner*—Neil Abrams

*Attorney, Agent, or Firm*—William B. Noll

[57] ABSTRACT

An electrical connector for electrical connection with a complementary electrical connector comprises an insulating housing (11, 31) having a first recessed portion (12, 32) opening outward. A plurality of electrical contact members (14) are secured in the housing (11, 31) and have contact sections extending along the first recessed portion but spaced inwardly from a front end of the housing (11, 31). A movable guide member has a second recessed portion (15*a,* 35*c*) and is positioned in the first recessed portion (12, 32) at an outer position and has holes (15*c*) in a bottom wall in which ends (14*a*) of the contact members are positioned. The guide member (15, 35) protects the contact sections of the contact members (14) and receives a section (21*a,* 41*a*) of the complementary connector (20, 40) therein when the connectors (10, 20; 30, 40) are connected with the section (21*a,* 41*a*) engaging and moving the guide member (15, 35) to an inner position during the connection with the holes (15*c*) aligning the contact sections for electrical engagement with the complementary contact members (22).

12 Claims, 4 Drawing Sheets

ELECTRICAL CONNECTOR HAVING A MOVABLE GUIDE MEMBER

FIELD OF THE INVENTION

The present invention relates to an electrical connector provided with electrical contacts arranged to extend inside a recess portion of a housing for receiving a matable electrical connector. More particularly, the present invention relates to an electrical connector that is provided with a movable guide member to prevent bending of the electrical contacts so that they will be readily engagable with the electrical contacts of the matable connector.

BACKGROUND OF THE INVENTION

Various types of electrical connectors for connecting a single electrical wire of a plurality of electrical wires are known and used. For example, electrical connectors including male and female contact members engagable with each other are widely used, and generally male contact members are secured in the female connector housing an receptacle contact members are secured in the male connector housing.

When the connection of a plurality of wires by using the above-mentioned connector is undertaken, a plurality of right-angled male contact members are arranged in a row in a female connector housing with the male contact members being accurately arranged in rows to ensure engagement of each male contact member with each respective receptacle contact member of a male connector housing at the time of connection between the matable connectors. However, often the male contact members are accidentally bent, because they are not protected. Accordingly, if the male contact members are bent, they will not properly mate with the respective receptacle contact members. Thus, a problem arises in that an incomplete electrical connection occurs.

SUMMARY OF THE INVENTION

To solve the problem of an incomplete electrical connection caused by bending of the contact members, according to the present invention an electrical connector is provided which will protect and prevent the contact members from being bent. The connector according to this invention comprises a connector housing having a first recessed portion opening outward, a plurality of male contact members secured in the housing and having contact sections extending along the first recessed portion, and a guide member which is movable in the engagement direction in the first recessed portion and comprising a second recessed portion opening outward and receiving a complementary connector. Further, in the engagement direction of the second recessed portion, a plurality of holes through which the contact sections will extend are located in a bottom wall of the guide member, and the guide member is temporarily held in the first recessed portion in an outer position such that only the ends of the contact sections of the male contact members extend through the holes.

When using the electrical connector having the above construction, the tip or end of each male contact member arranged in the first recessed portion rearwardly from the front of the housing is disposed in a hole of the guide member which is temporarily held in an outer position in the first recessed portion, and therefore, bending of the contact sections is prevented because the tips thereof are retained in position by the holes. To connect this connector with a complementary connector, first the complementary connector is inserted in the second recessed portion of the guide member, and the complementary connector is inserted further into the second recessed portion thereby releasing the temporarily held guide member, and thus the guide member is pushed further into the first recessed portion together with the complementary connector. Accordingly, as the guide member is pushed into the first recessed portion, each contact section extends further through the holes, and each contact section projects inside the second recessed portion and is electrically engaged with each respective receptacle contact member of the complementary connector when completely inserted in the second recessed portion. Therefore, because the contact sections of the male contact members first extend through the holes of the guide member and then project inside the second recessed portion thereof, any bending of any part of the contact sections, including the tips, can be corrected by the holes as the guide member moves along the first recessd portion from an outer position to an inner position.

BRIEF DESCRIPTION OF THE DRAWINGS

An electrical connector according to this invention will now be described by way of example with reference to the following detailed description and the accompanying drawings, in which.

DETAILED DESCRIPTION OF THE INVENTION

Figure 1:
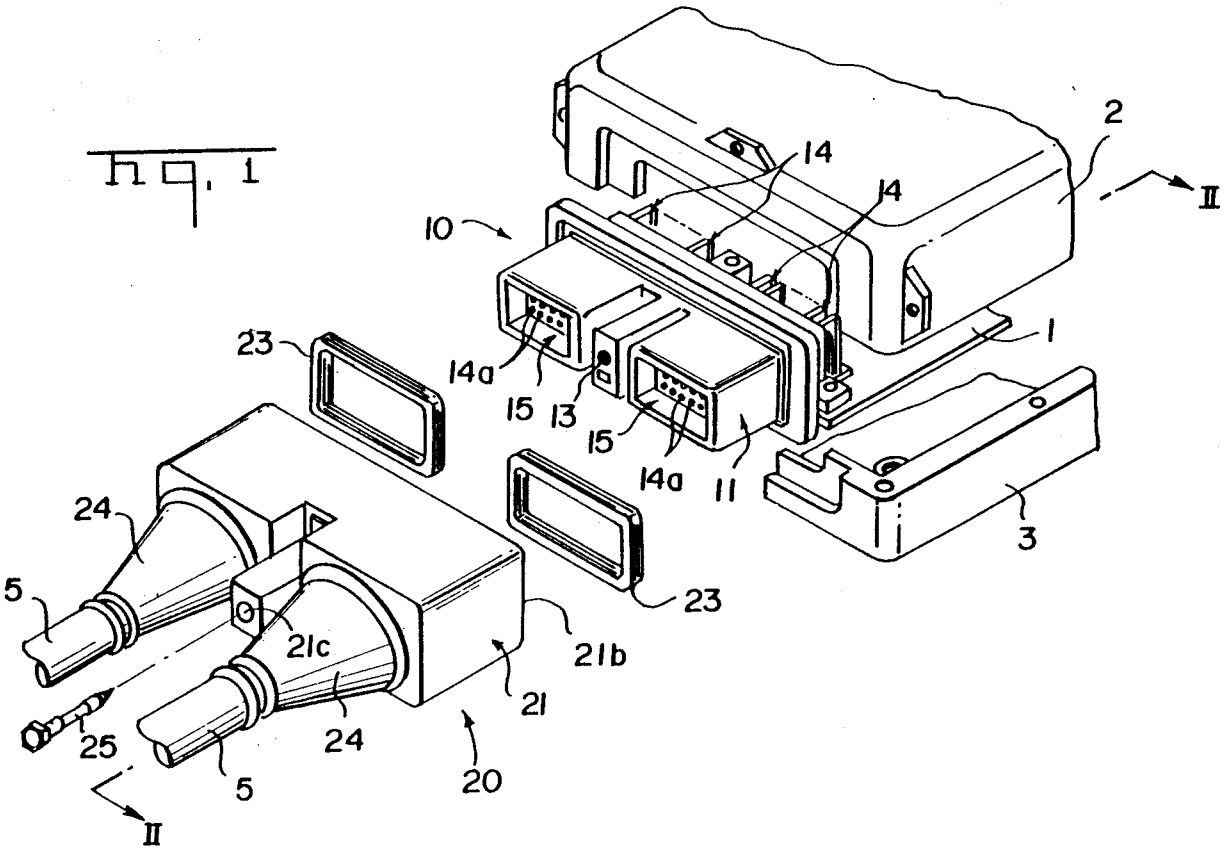
FIG. 1 is a perspective exploded view showing the electrical connector according to this invention and a complementary connector.

FIG. 1 shows a female electrical connector 10 together with an opposed male electrical connector 20 which is to be electrically connected with female connector 10.

Female connector 10 is composed of a plurality of male contact members 14 arranged in and retained by an insulating housing 11. One end of a terminating section of each male contact member 14 is connected with a P.C. board 1 to which the housing 11 is fixed. The other section of contact member 14, which is bent at a right angle, extends through a passageway 11a and into a first recessed portion 12 in housing 11 as a contact section, recessed portion 12 opening outwardly. This female connector 10 is fitted to upper and lower units 2, 3 in such a manner that the P.C. board 1 is received therein.

Figure 2:
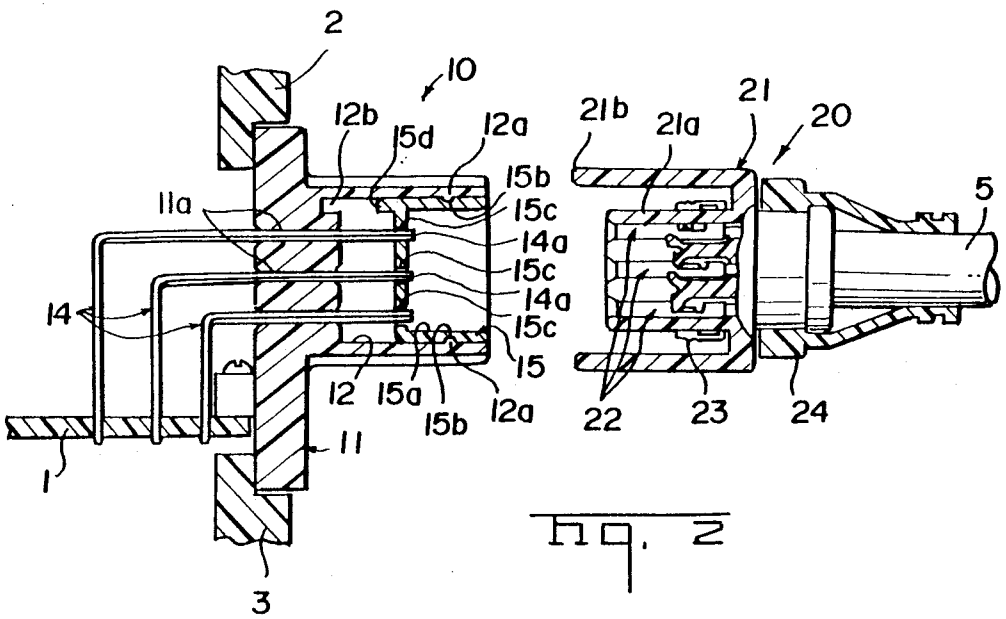
FIG. 2 is a cross-sectional view showing the connectors of FIG. 1 along the line II—II prior to engagement.

A guide member 15 is disposed in first recessed portion 12 and has a second recessed portion **15*a* which opens outward when in the first recessed portion 12. A plurality of holes 15*c*, which are aligned with the plurality of contact members 14, are located in the bottom wall of guide member 15. An outside surface of guide member 15 has a temporary-holding slot 15***b* which engages with a projection 12*a* located on an inside surface of first recessed portion 12, whereby the guide member 15 is temporarily held and retained in an outer position by the engagement of projection 12*a* and slot 15*b* in which only the tips or ends 14*a* of the male contact members 14 are located in holes 15c of guide member 15 as shown in FIG. 2. Therefore, because the tips 14*a* of the contact sections of male contact members 14 are located in holes 15*c* of guide member 15 and retained thereby, a misregistration of the tips of male contact members 14 with respective receptacle contact members is avoided and bending of contact members 14 as well as damage thereto is prevented as they are protected by guide member 15.

Thus, the contact sections of the male contact members 14 are positioned a distance from the front of housing 11 within recessed portion 15*a* of guide member 15 so as to be better protected and prevented from being bent or damaged.

Male connector 20, which is electrically engaged with female connector 10, is composed of a plurality of receptacle contact members 22 arranged in a row and secured in an insulating housing 21. Electrical wires in cable 5 are connected with each receptacle contact member 22, respectively. Housing 21 comprises plug portion 21*a* in which receptacle contact members 22 are secured and hood portion 21*b*. Plug portion 21*a* is insertable in second recessed portion 15*a* in guide member 15 of female connector 10. To ensure that the connector according to this invention is water-proof, seals 23 are provided between each plug portion 21*a* and each hood portion 21*b* and rubber boots 24 are fitted over the joining of cables 5 with housing 21.

Figure 3:
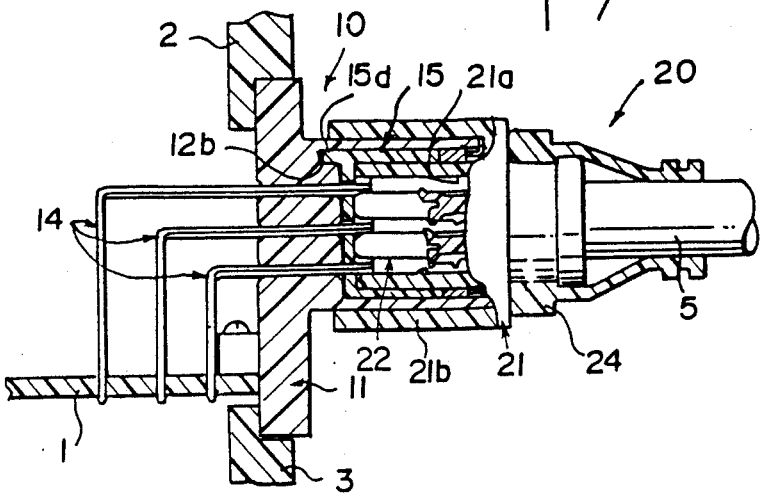
FIG. 3 is a cross-sectional view showing the connectors in engagement.

FIG. 3 shows the engagement between female connector 10 and male connector 20, and the following is an explanation of such engagement. To connect both connectors, plug portion 21*a* of male connector 20 is inserted in second recessed portion 15*a* of guide member 15 of female connector 10. When the outer end of plug portion 21*a* reaches a position where the outer end engages with the bottom wall of guide member 15, guide member 15 is released from its temporary hold position provided by the engagement of slot 15*b* of guide member 15 with projection 12*a* of first recessed portion 12 and is then moved into first recessed portion 12 by plug portion 21*a* of male connector 20 moving further therein. Therefore, as guide member 15 moves inward along first recessed portion 12, the contact sections of contact members 14 project into second recessed portion 15*a* , and these contact sections 14 are received by respective rceptacle contacts 22 thereby electrically connecting contact members 14 and receptacle contact members 22. The contact sections of contact members 14 are guided by holes 15*c* when guide member 15 moves inwardly, and any bending of these contact sections is corrected by such movement of holes 15*c* therealong. The box shape of guide member 15 stabilizes it in first recessed portion 12 and its movement therealong.

Figure 4:
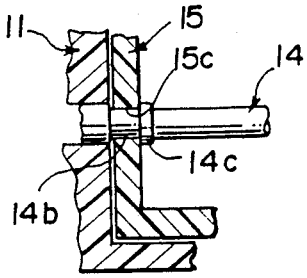
FIG. 4 is a part cross-sectional view showing the details of the engaging portion between a male contact member and a guide member in FIG. 3.

A projection 15*d* is located at the inner end of guide member 15 which frictionally engages with a cavity 12*b* formed in the bottom surface of first recessed portion 12, as shown in FIG. 3; thus, this will securely retain guide member 15 in the inner position in first recessed portion 12. Also, in an alternative embodiment as shown in FIG. 4, some of male contact members 14 have an annular recess 14*b* and an annular projection 14*c* so that holes 15*c* of guide member pass over projections 14*c* and are disposed in recesses 14*b* when guide member 15 is at its inner position when connectors 10, 20 are connected thereby retaining guide member 15 in the inner position in first recessed portion 12.

As shown in FIG. 1, to ensure the connection of both connectors, a bolt 25 can be screwed into a threaded hole 13 formed in housing 11 of female connector 10 through a hole 21*c* in housing 21 of male connector 20.

FIGS. 5A to 5D show a different embodiment of the female connector of this invention and the opposed connector to be connected therewith. Female connector 30 includes a housing 31 wherein a plurality of male contact members 14 are arranged and secured with contact sections thereof extending along a recessed portion 32, and a guide member 35 having a second recessed portion 35*c* and having the tips of the contact sections of male contact members 14 disposed in holes in the bottom of guide member 35. Guide member 35 is temporarily held and retained in an outer position inside first recessed portion 32 of housing 31 by a first projection 35*a* on the outside surface of guide member 35 engaging with a retaining aperture 31*a* in the upper wall of first recessed portion 32 of housing 31.

Figure 5A:
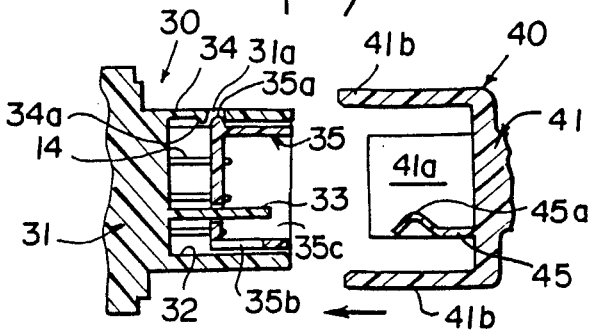
FIGS. 5A to 5D are cross-sectional views showing a different embodiment of the connector according to this invention in conjunction with the complementary connector.

A flexible arm 34 is also located in the upper wall of first recessed portion 32 in alignment with retaining aperture 31*a*, and first projection 35*a* is retained inside retaining aperture 31*a* by a second projection 34*a* at the tip of flexible arm 34. Further, housing 31 is provided with a press plate 33 projecting from the bottom of and along first recessed portion 32. Press plate 33 extends through a hole in the bottom of guide member 35 and extends along second recessed portion 35*c*. In addition, a latching aperture 35*b* is formed in the bottom wall of guide member 35 in alignment with press plate 33, as best shown in FIG. 5A.

Male connector 40 has a housing 41 comprising a plug portion 41*a* retaining a plurality of receptacle contact members (not shown), hood portion 41*b*, and a flexible latching arm 45 including a hook section 45*a* extending outwardly and forwardly from a bottom surface of hood portion 41*b*.

Figure 5B:
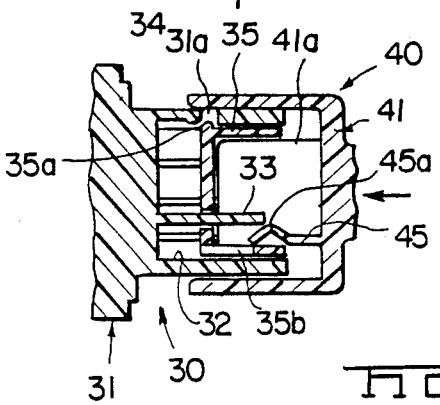
Figure 5C:
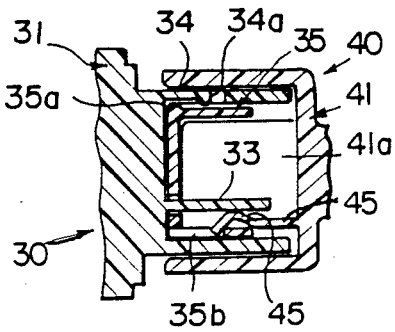
Figure 5D:
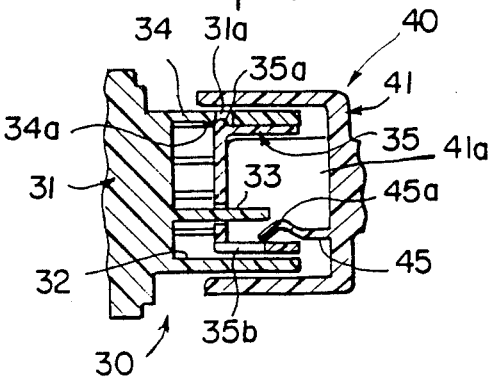

To connect male connector 40 with female connector 30, plug portion 41*a* of male connector 40 is inserted in the second recessed portion 35*c* of guide member 35, as shown in FIG. 5B. Then hook section 45*a* of latching arm 45 is disposed between the inside surfaces of press plate 33 and guide member 35. When plug portion 41*a* of male connector 40 is further inserted into female connector 30, guide member 35 is moved along first recessed portion 32 by plug portion 41*a* causing first projection 35*a* of guide member 35 to pass over second projection 34*a* of flexible arm 34 and guide member 35 moves along first recessed portion 32 until both connectors are completely engaged, as shown in FIG. 5C. At this time, the end of hook section 45*a* of latching arm 45 is pressed into latching aperture 35*b* of guide member 35 by being pressed thereinto by press plate 33.

To disengage connectors 30, 40 male connector 40 is pulled in the direction away from female connector 30 or both connectors can be pulled in opposite directions. However, when male connector 40 is pulled away from female connector 30, latching arm 45 moves with male connector 40 and guide member 35 also moves to its outer position because the end of hook section 45*a* of latching arm 45 is engaged in latching aperture 35*b* of guide member 35. Thus, guide member 35 is moved to the temporary held position shown in FIGS. 5A, and 5D. At this position, press plate 33 and latching arm 45 are no longer in engagement, and first projection 35*a* is disposed within retaining aperture 31*a* whereby guide member 35 is temporarily held at this outer position. Thus, when diconnecting connectors 30, 40, guide member 35 is moved by male connector 40 to the temporary holding position, and the tips of the contact sections of contact members 14 are positioned in the holes therein.

As explained above according to the present invention, the tips of the contact sections of male contact members arranged in the first recessed portion of the connector housing of theconnector are located in holes of the guide member, which is disposed and temporarily held in an outer position in the first recessed portion. Thus, bending of the contact sections is prevented because the tips thereof are located in the holes. To connect this connector with a complementary connector, first a male section of the complementary connector is inserted in the second recessed portion of the guide member, the male section of the complementary connector is then further inserted in the second recessed portion to release the temporarily-held guide member, and then the guide member is further pushed into the first recessed portion together with the male section of the complementary connector, and each male contact member extends through each hole and projects inside the second recessed portion and is electrically engaged with each respective receptacle contact member of the male section of the complementary connector inserted in the second recessed portion. Therefore, because the male contact members extend through the holes and project inside the second recessed portion, a bend in any part of each contact section of male contact member or misalignment thereof, including the tips, is corrected by the holes in the guide member as it is moved from its outer position to its inner position.

A latching arrangement is also provided between the movable guide member and the complementary connector which moves the guide member from the inner position to the outer position when the connectors are disconnected.

I claim:

1. An electrical connector for electrical connection with a complementary electrical connector, comprising:

a dielectric housing having a first recessed portion opening outward;

a plurality of male contact members secured in said housing and having contact sections extending along the first recessed portion with the front ends of the contact sections being spaced inwardly from a front end of the housing;

a guide member completely positioned within said first recessed portion and having a second recessed portion opening outward, a bottom wall of said guide member having holes through which the front ends of the contact sections extend thereby protecting the contact sections and preventing them from being bent, the guide member being movable from an outer position to an inner position; and holding means between said housing and said guide member to hold said guide member at said outer position, said guide member upon being engaged by the complementary electrical connector, when a section thereof is inserted into the second recessed portion, being moved from the outer position to the inner position in the first recessed portion so that the contact sections are guided by the holes into electrical engagement with respective matable contact members of the complementary electrical connector.

2. An electrical connector as claimed in claim 1, wherein means are provided between said guide member and said housing to maintain said guide member at said inner position.

3. An electrical connector as claimed in 2, wherein said maintaining means comprise a projection on said guide member and a recess in said housing in which said projection is frictionally disposed.

4. An electrical connector as claimed in claim 2, wherein maintaining means are provided to maintain the guide member at the inner position which comprise an annular recess in at least one of said male contact members adjacent an annular projection so that the hole through which at least one of the contact members extends passes over the annular projection and is disposed in the annular recess

5. An electrical connector as claimed in claim 1, wherein said holding means comprise projection means in said first recessed portion matable with recess means on exterior surface means of said guide member.

6. An electrical connector as claimed n claim 1, wherein said holding means comprise a flexible member having a projection in a wall of said housing in alignment with an aperture therein, projection means on said guide member for disposition in said aperture.

7. An electrical connector as claimed in claim 1, wherein latch means are provided between said guide member and the complementary connector for latching the guide member to the complementary connector when the guide member is in the inner position so that when the complementary connector is disconnected from the electrical connector the guide member is moved to the outer position.

8. An electrical connector as claimed in claim 7, wherein the latch means comprise a press plate extending outwardly from a bottom surface of said first recessed portion in alignment with an opening in a side wall of said guide member and a flexible latching arm having a hook section extending outwardly from a housing member of the complementary connector, said hook section moving along said press plate as the connectors are connected together with the outer end of the hook section being pressed by the press plate into the opening when the guide member is at said inner position.

9. An electrical connector for electrical connection with a complementary connector, comprising:

an insulating housing having a first recessed portion and electrical contact members secured in said housing with contact sections extending along said first recessed portion;

a guide member completely positioned in said first recessed portion and having a second recessed portion, said guide member having a bottom wall through which holes extend, the ends of the contact sections are disposed in the holes when the guide member is in an outer position thereby protecting the contact sections and preventing them from being bent, said guide member being movable along said first recessed portion from said outer position to an inner position by the complementary connector when the complementary connector is connected with the electrical connector so that the contact sections are exposed as the guide member moves inwardly and the contact sections are aligned by the holes for electrical engagement with the complementary contacts of the complementary connector; and means are provided between the housing and said guide member to hold said guide member in said outer position until the guide member is moved to the inner position by the complementary connector.

10. An electrical connector as claimed in claim 9, wherein said holding means comprise projection means in said first recessed portion and recess means in an outer surface of said guide member.

11. An electrical connector as claimed in claim 9, wherein means are provided between said guide member and said housing to maintain said guide member at said inner position.

12. An electrical connector as claimed in claim 9, wherein means are provided between the guide member and the complementary connector to move the guide member to the outer position when the complementary connector is disconnected from the electrical connector.

* * * * *